US006317971B1

(12) United States Patent
Colarusso et al.

(10) Patent No.: US 6,317,971 B1
(45) Date of Patent: Nov. 20, 2001

(54) DISSIMILAR ELEMENT MECHANICAL AND ELECTRICAL CONNECTION AND METHOD

(75) Inventors: Louis J. Colarusso, Macedonia; Jeff Kadlowec, Maple Heights; Ray Olle, Seven Hills, all of OH (US)

(73) Assignee: Erico International Corporation, Solon, OH (US)

( * ) Notice: Subject to any disclaimer, the term of this patent is extended or adjusted under 35 U.S.C. 154(b) by 0 days.

(21) Appl. No.: 09/375,671

(22) Filed: Aug. 17, 1999

Related U.S. Application Data

(60) Provisional application No. 60/096,930, filed on Aug. 18, 1998.

(51) Int. Cl.[7] ..... H01R 43/00

(52) U.S. Cl. ..... 29/825

(58) Field of Search ..... 29/825, 402.01, 29/402.18; 403/270; 205/369; 204/286.1; 228/118, 119

(56) References Cited

U.S. PATENT DOCUMENTS

| | | | |
|---|---|---|---|
| 3,999,030 | | 12/1976 | Nakazaki et al. . |
| 4,457,811 | * | 7/1984 | Byrne . |
| 4,468,299 | * | 8/1984 | Byrne et al. . |
| 4,488,946 | * | 12/1984 | Morris et al. . |
| 4,560,452 | * | 12/1985 | Morris et al. . |
| 4,568,434 | * | 2/1986 | Morris et al. . |
| 4,581,114 | * | 4/1986 | Morris et al. . |
| 4,658,886 | * | 4/1987 | Carlson et al. . |
| 4,934,579 | | 6/1990 | Doble . |
| 5,279,455 | | 1/1994 | Fuchs . |
| 5,647,425 | | 7/1997 | Foutz et al. . |
| 5,653,279 | | 8/1997 | Foutz et al. . |

FOREIGN PATENT DOCUMENTS

8205063 U 3/1984 (DE) .

OTHER PUBLICATIONS

CADWELD Bus Bar Connections catalog dated 1979.

* cited by examiner

*Primary Examiner*—Carl J. Arbes
(74) *Attorney, Agent, or Firm*—Renner, Otto, Boiselle & Sklar, LLP

(57) ABSTRACT

A connection is provided between two dissimilar elements, such as an aluminum bus and a copper contact. Also provided is a method and apparatus for making the connection. One application is as an anode electrode hanger in an electric smelting furnace. The connection provides a lower resistance electrical connection which can be made while the power to the system is on. In a preferred form the contact is inserted and clamped in the bottom of a chamber in a refractory mold assembly. The chamber opening to the face of the mold assembly is somewhat deeper than the contact. The face of the mold assembly is clamped against the bus, and exothermic weld material is ignited to form a molten metal which drops into the chamber between the contact and bus. The weld metal forms a molecular weld bond with the bus, but only a mechanical interlock with the contact. To enhance the mechanical interlock and to improve the electrical conductivity, the surface area of the contact exposed to the weld metal is significantly increased, and the interlock formed increases both the strength of the connection and its electrical conductivity. The surface area increase is obtained by forming a series of parallel vertical undercut slots in the surface of the contact exposed to the weld metal, and such surface may also be tinned to form a brazed mechanical connection. The connection of the dissimilar metals can be made without shutting off the power and provides improved electrical conductivity.

14 Claims, 6 Drawing Sheets

DISSIMILAR ELEMENT MECHANICAL AND ELECTRICAL CONNECTION AND METHOD

DISCLOSURE

This application claims the priority of and is a continuation of provisional application file Aug. 18, 1998, Ser. No. 60/096,930. This invention relates generally as indicated to a mechanical and electrical connection between two dissimilar elements or materials, and to a method of making the connection.

BACKGROUND OF THE INVENTION

It has been the practice in, for example, aluminum electrosmelting operations to utilize aluminum bus bars which have affixed thereto copper contacts to which copper anode or furnace electrode hangers are clamped. The contact may take the form of a square or diamond-shape plate which is simply Mig welded along two or all four edges of the contact plate to the vertical major face of the aluminum bus.

This attachment system has a number of drawbacks. The first is that the connection does not provide a very good electrical connection between the bus and contact plate. The welding may cause a slight distortion of the plate, and, in any event, the current flows almost completely through the edge welds and not through the major flat surfaces even though they are supposedly abutting. This problem is made worse by wear and tear in the bus itself. Aluminum is a relatively soft metal and over years of use is subject to denting and scratching. The exposed face of the bus can become rather beat up. Without clamping pressure over the entire major surface and good area-to-area contact, the abutting surfaces with any irregularities or distortions create a small air gap, so that the major area of the plate facing the face of the bar acts like the plate of a capacitor. The connection has much higher resistance than it should.

Another major problem is that Mig welding requires the power to the system to be shut down. This can be costly and disturbing to the entire process. Power to electrometallurgical or smelting systems is designed to be continuous and literally run for months or even years. Power shutdowns can be very costly. Even where the power shutdowns are scheduled in advance, the extent of the shutdown for maintenance, repairs or replacements is, wherever possible, minimized. For many large scale electrical consumers, such as an electrical smelting operation, power is paid for, whether used or not. Also with scheduled power shutdowns and maintenance windows, it is then inherent that repairs or replacements may not be made when they should be made, making the system in that way inefficient.

Accordingly, the Mig welding connection process provides neither a good electrical nor necessarily a good mechanical connection between the two dissimilar metals.

It would be desirable to provide a connection between the two dissimilar metals which would be both a good electrical connection and a good long-lasting mechanical connection. It would also be desirable if the connection could be made without shutting off the power.

SUMMARY OF THE INVENTION

A connection and a method and apparatus for making the connection is provided between two dissimilar elements, such as an aluminum bus and a copper contact. One application is as an anode electrode hanger in an electric smelting furnace. The connection provides a lower resistance electrical connection which can be made while the power to the system is on. In a preferred form the contact is inserted and clamped in a chamber in a refractory mold assembly. The chamber opening to the face of the mold assembly is somewhat deeper than the contact. The face of the mold assembly is clamped against the bus, and exothermic weld material is ignited to form a molten metal which drops into the chamber between the contact and bus. The weld metal forms a molecular weld bond with the bus, but only a mechanical interlock with the contact. To enhance the mechanical interlock and to improve the electrical conductivity, the surface area of the contact exposed to the weld metal is significantly increased, and the interlock formed increases both the strength of the connection and its electrical conductivity. The surface area increase is obtained by forming a series of parallel vertical undercut slots in the surface of the contact exposed to the weld metal, and such surface may also be tinned to form a brazed mechanical connection. The connection of the dissimilar metals can be made without shutting off the power and provides improved electrical conductivity.

The increase in surface area may be in the ratio of about 1.5 to about 2.5 times or more, and is obtained by such undercut channels. The channels may be dovetailed and conveniently formed in circular section with a reduced chordal opening to the weld metal chamber. The channels extend in the direction of flow of the metal. In a preferred form, the contact is provided with flats for better alignment and gripping in the mold assembly.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
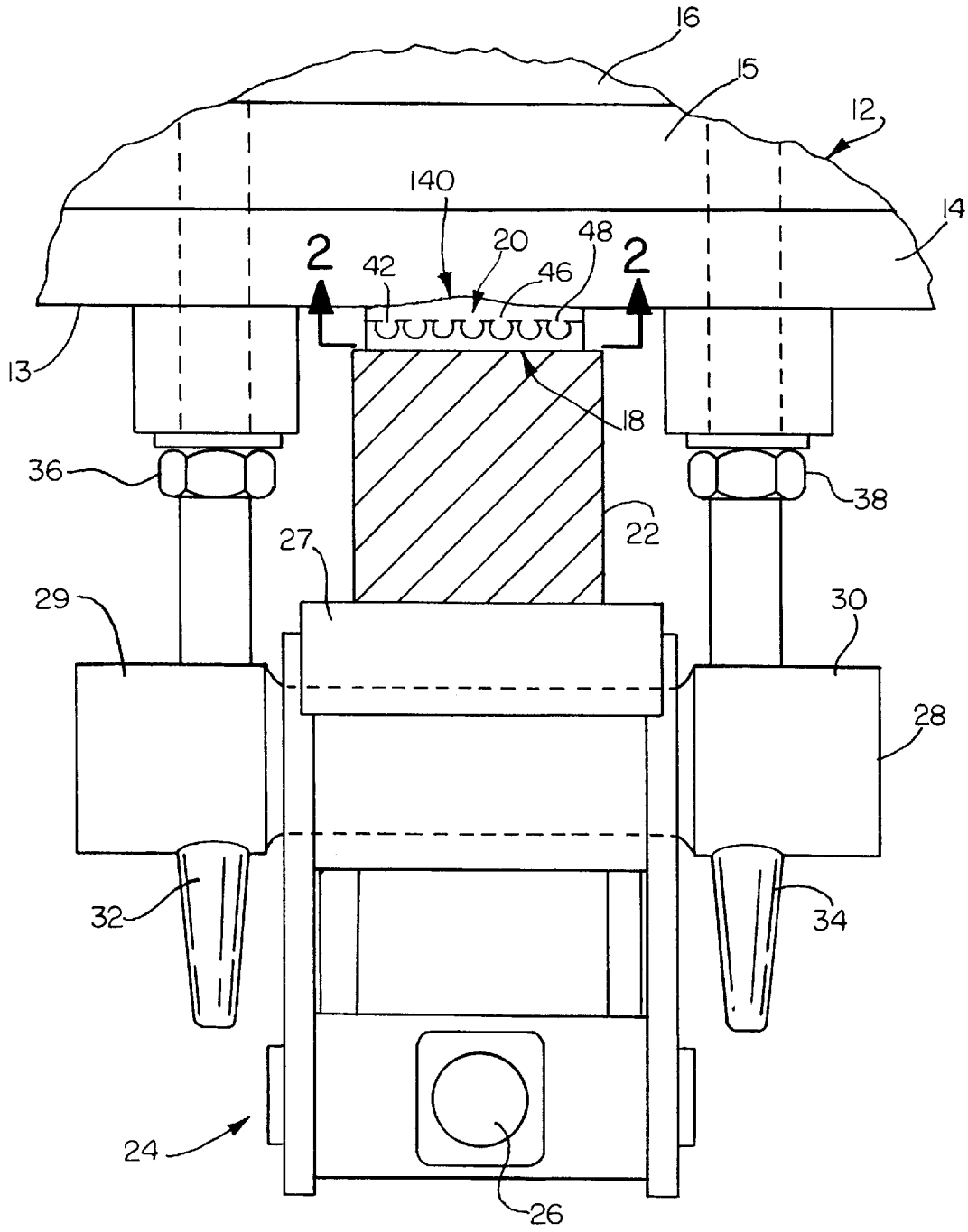
FIG. 1 is a top view of a bus bar contact connection of a furnace anode hanger in accordance with the present invention.

Referring initially to FIG. 1 there is illustrated an aluminum bus shown generally at 12 which includes a face 13.

The bus assembly may include a number of contiguous bus bars shown at 14, 15 and 16.

Secured to the face of the aluminum bus assembly is a copper contact shown generally at 18. The copper contact is secured to the face of the bus by an aluminum weld metal shown generally at 20 which forms a molecular weld with the face of the bus bar assembly, but only a mechanical connection with the copper contact 18.

Figure 8:
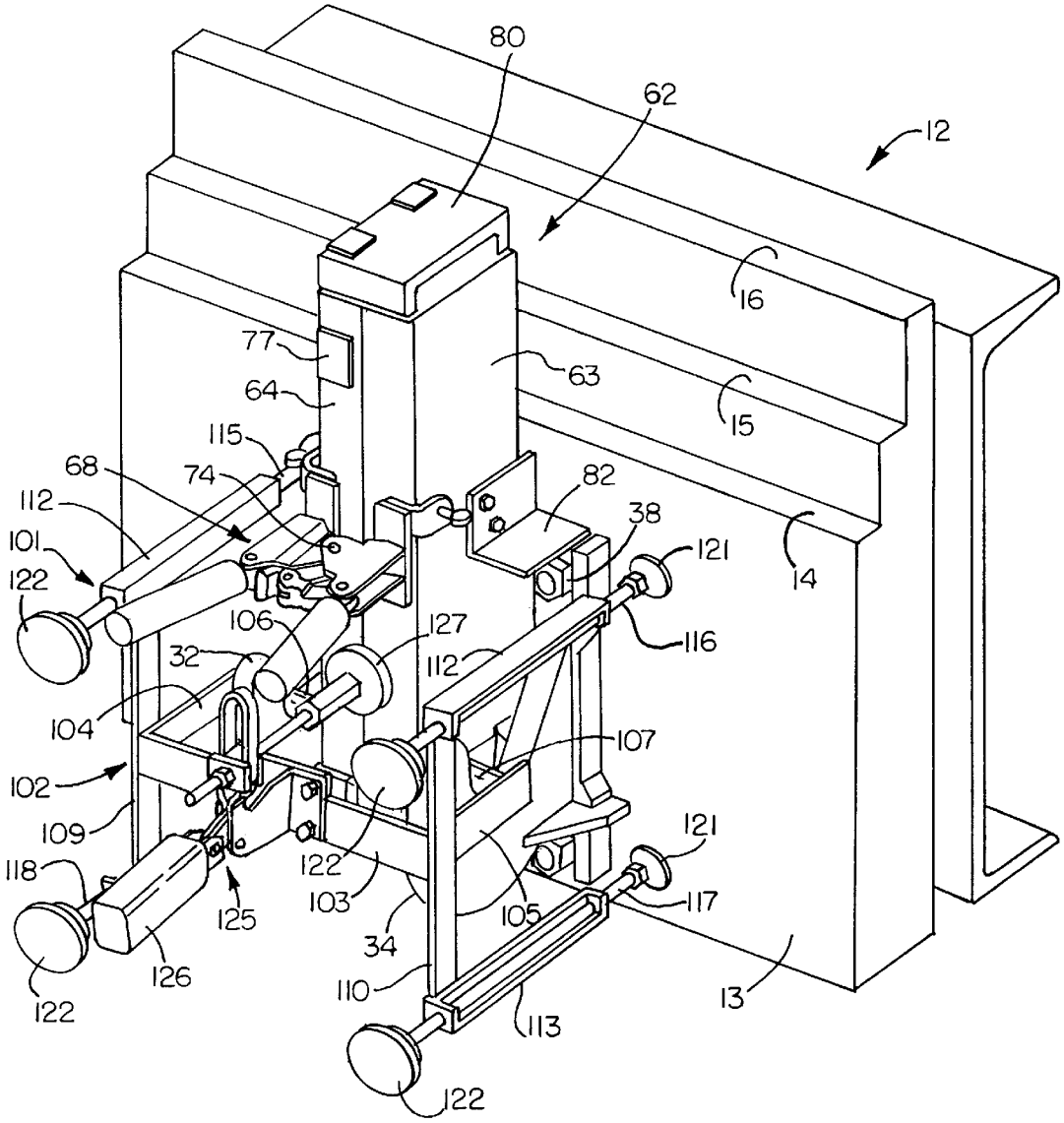
FIG. 8 is a perspective view of the fixture supporting the mold assembly clamped against the bar.

As seen in FIG. 1, the copper contact engages a vertically extending anode hanger 22 which is held in place by the clamp assembly shown generally at 24. The clamp assembly is a scissors-type clamp which is operated by rotating turn-buckle 26 to pivot clamp shoes 27 about the axis of pivot shaft 28. The pivot shaft includes enlarged ends 29 and 30 which are nested in the crotch of up-turned hooks 32 and 34, respectively, which are mounted on each side of contact 18 by top and bottom fasteners shown generally at 36 and 38, respectively. The hanger on its lower end supports a carbon anode or electrode for a smelting furnace. The two hooks are positioned side-by-side to project from the face of the aluminum bus assembly and are symmetrical with the contact therebetween. The hooks 32 and 34 are also shown in FIG. 8 in perspective but are somewhat obscured.

Figure 2:
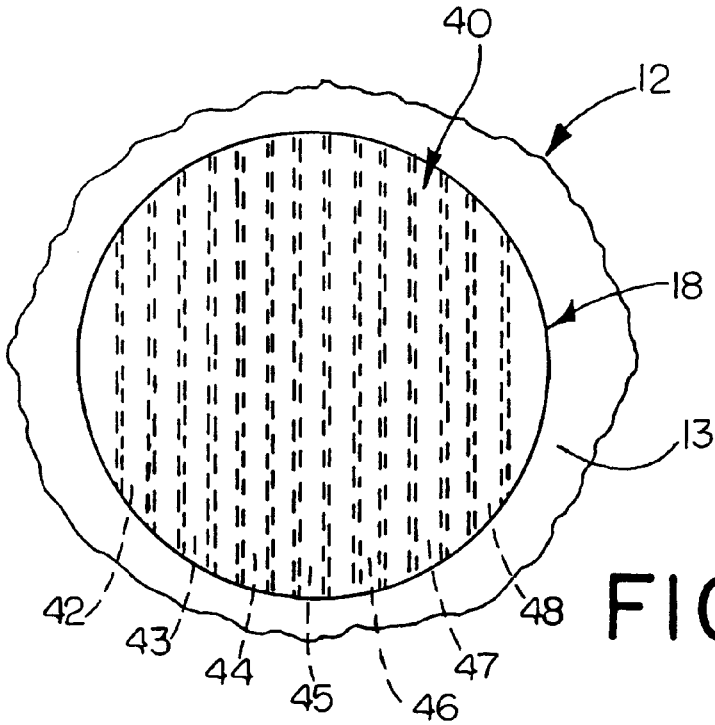
FIG. 2 is a view from the contact surface as seen from the line 2—2 of FIG. 1.

Referring now to FIG. 2, there is illustrated the face of the contact seen at 40 against which the hanger 22 abuts when clamped in position. In FIG. 2, the contact, sometimes referred to as a puck, is completely circular. As shown by the dotted lines, the interior surface of the contact facing the bus bar face 13 is provided with a series of undercut grooves each of which extend parallel to the other and vertically. In the embodiment of FIG. 2, there are seven such grooves shown at 42, 43, 44, 45, 46, 47 and 48. The top of the grooves are seen in FIG. 1. As an example, the overall thickness of the anode contact 18 may be approximately 8 mm, while the vertical grooves in the interior face may be formed with a diameter of about 5 mm, with the center of the groove approximately 1.5 mm from the interior face. This provides a narrowed slot opening to the interior of the connection with substantial undercut on each side of the slot opening. By providing the interior of the contact surface with the undercut or dovetail grooves as illustrated, the surface area of the interior of the contact is greatly increased. The surface enlargement area ratio is preferably from about 1.5 to about 2.5 or more. It will of course be appreciated that other forms of undercut grooves may be employed.

Figure 3:
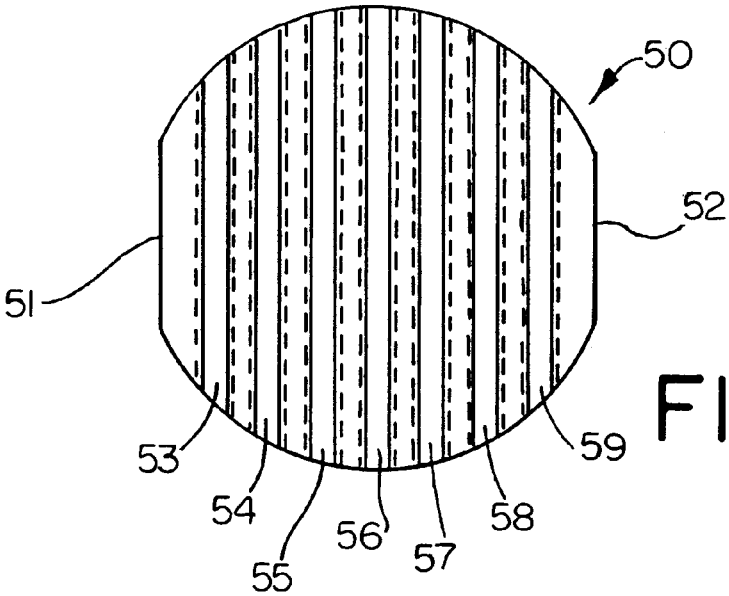
FIG. 3 is a view of the opposite surface of a somewhat modified contact.
Figure 4:
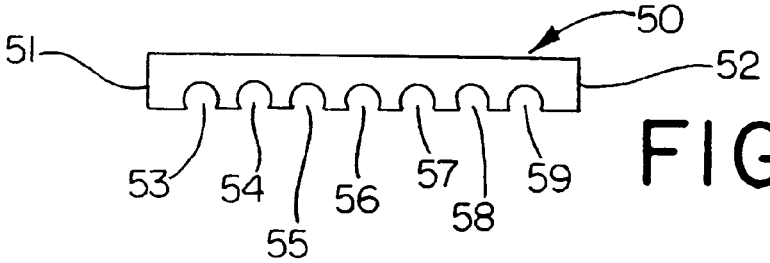
FIG. 4 is a top plan view of the contact of FIG. 3.

Referring now to FIGS. 3 and 4, there is illustrated a slightly different preferred form of contact 50. FIG. 3 is looking at the interior face of the contact, while FIG. 4 illustrates the top. The major difference in the geometry of the contact is that it is provided with flat sides seen at 51 and 52 which are parallel to the grooves 53, 54, 55, 56, 57, 58 and 59. It is also noted that the contact 50 of FIGS. 3 and 4 is somewhat elongated vertically, and that the contact is not otherwise a full circle simply with two chordal flats. Thus the contact of FIGS. 3 and 4 has a somewhat larger surface area in spite of the flats. The flat sides also aid in alignment of the contact in the process of securing the contact to the face of the bus. In some applications, the space constraints between the projecting hooks 32 and 34 also makes the narrower contact easier to use and apply.

Figure 5:
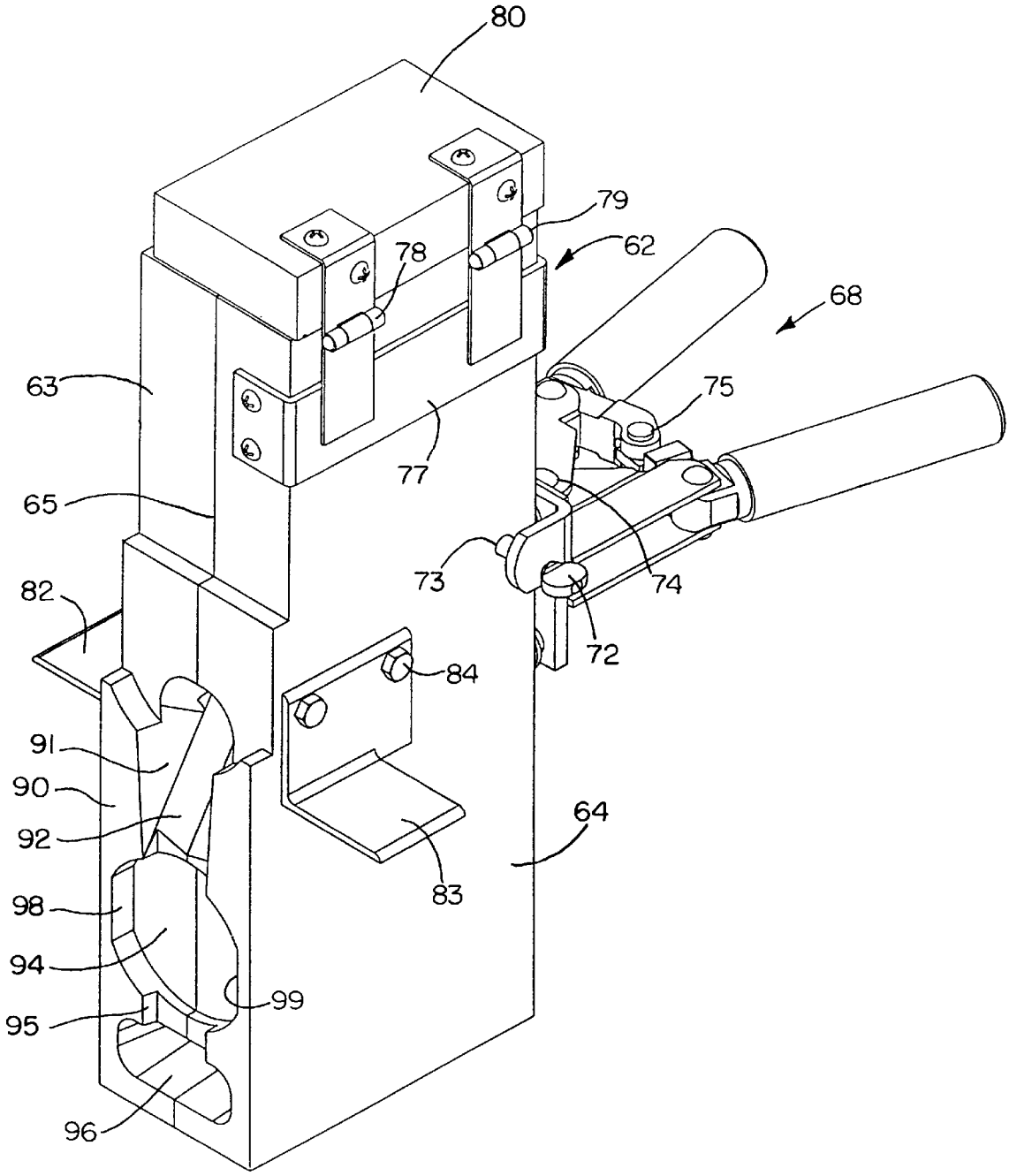
FIG. 5 is a perspective view of a mold assembly for making the connection.
Figure 7:
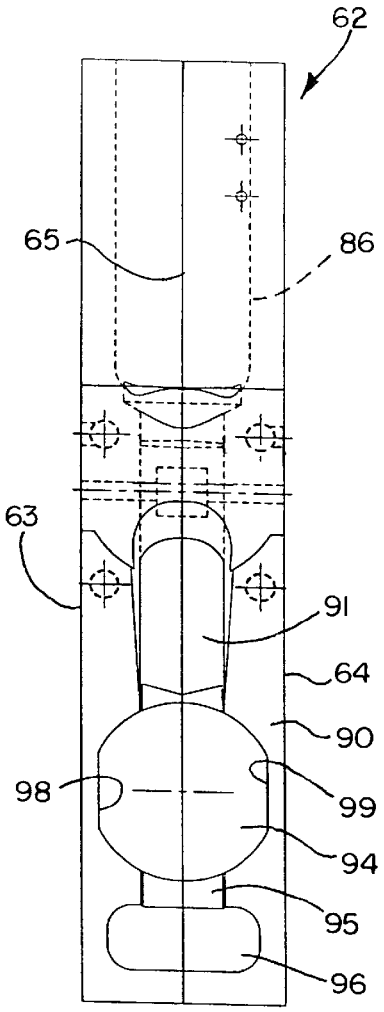
FIG. 7 is a view from the left side or face of the assembly of FIG. 5.
Figure 6:
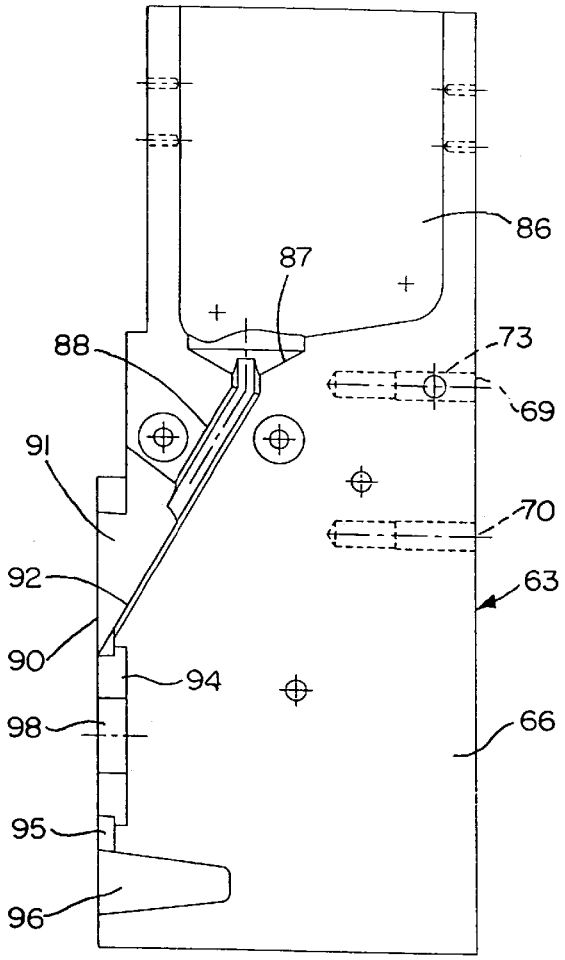
FIG. 6 is a plan view of one of the two mold parts forming the assembly of FIG. 5 at the clamping parting plane.

Referring now to FIGS. 5, 6 and 7, there is illustrated the mold assembly which is utilized in the process of securing the copper contact to the face of the aluminum bus. The mold assembly is shown in FIGS. 5 and 6 generally at 62. The mold assembly may be machined from refractory blocks such as graphite. The mold assembly is formed of two primary blocks seen at 63 and 64. The mold blocks are clamped together at the parting faces 65. When clamped together, the mold parts form various chambers and runners as will more clearly be explained with reference to FIG. 6 which illustrates the interior parting plane 66 of the mold part 63.

The two mold parts are held for opening and closing as well as clamping by the toggle assembly shown generally at 68 in FIG. 5. The two parts of the toggle assembly are secured to the mold parts by pins inserted in the holes 69 and 70 seen, for example, in FIG. 6 and locked in place by the right angle thumb screw 72 which enters through the transverse hole 73. The two mold parts are hinged for opening and closing movement about the hinge pin seen at 74 and may be clamped shut through the toggle pivot connection 75.

Secured to the top of the mold 64 is a strap 77 to which are secured two hinges 78 and 79 which support lid 80. Secured to the exterior of each mold are two angle brackets seen at 82 and 83 which may be secured to the mold parts by the fasteners seen at 84. As will be hereinafter described, the brackets assist in supporting the mold assembly on top of the hooks 32 and 34. The toggle operated mold parts are typical of the mold assemblies made and sold by Erico, Inc. of Solon, Ohio, U.S.A., under the trademark CADWELD®.

With special reference to FIG. 6, it will be seen that when the mold parts are clamped together, various recesses are formed in each clamping face which cooperate to form various chambers and runners as described. The uppermost chamber is a crucible 86 for containment of exothermic weld material. The lower end of the crucible is provided with a funnel passage 87 which communicates with a runner or tap hole 88. The tap hole extends initially vertically and then is inclined toward the face 90 of the mold assembly, and opens into a wedge-shaped chamber 91. The tap hole is aligned with the inclined bottom 92 of the chamber 91. The wedge chamber opens into the top of contact chamber 94. The bottom of the contact chamber is connected through passage 95 to overflow chamber 96. It is noted that each of the wedge chamber, the contact chamber, and the overflow chamber, together with the interconnecting passages are exposed to the face 90 of the mold assembly. It will be seen that the contact chamber 94 includes lateral flats 98 and 99 which correspond to the contact flats 51 and 52.

Figure 10:
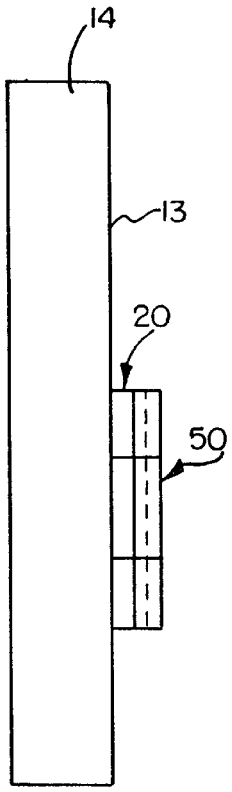
FIG. 10 is a view like FIG. 9 but with the mold and excess weld metal removed leaving only the connection.
Figure 9:
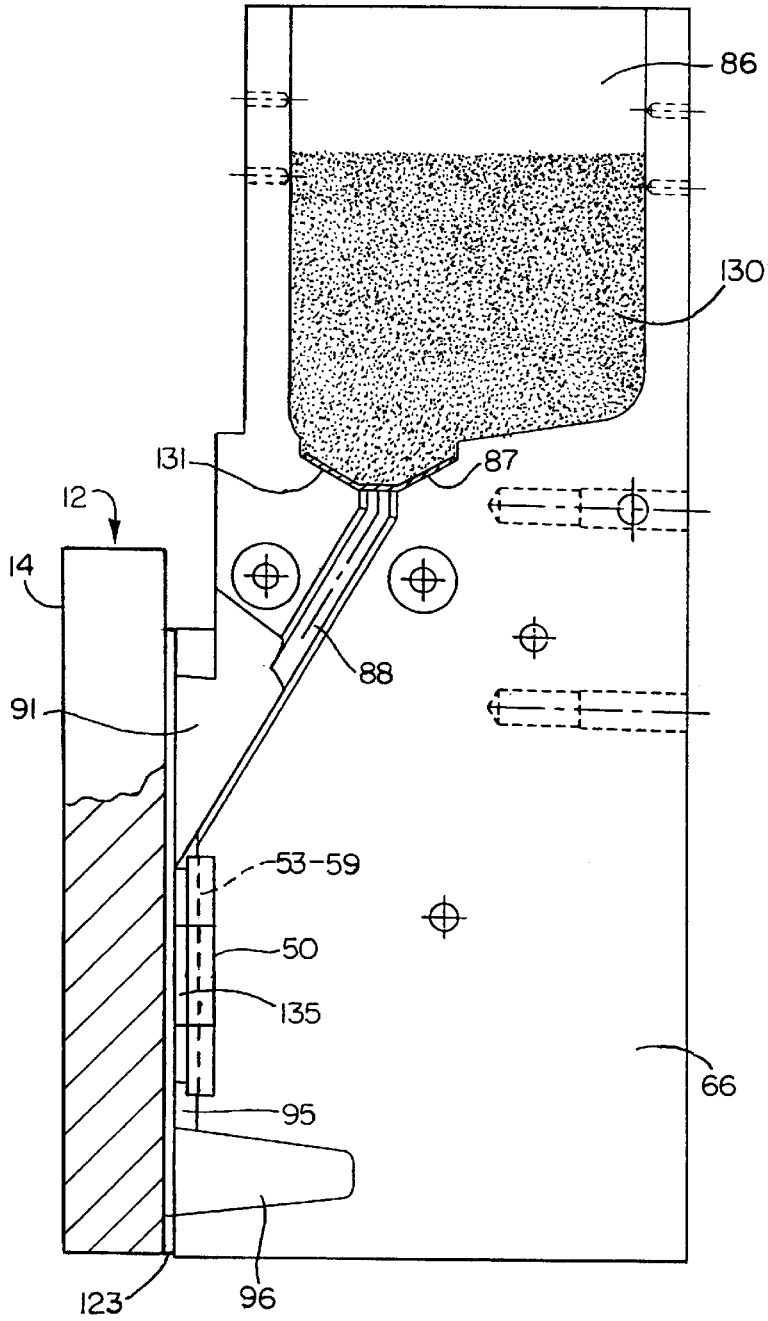
FIG. 9 is a slightly enlarged view like FIG. 6 but showing the contact in place and the assembly clamped against the bus forming the cavity.

Referring now to FIGS. 8, 9 and 10, and initially to FIG. 8, there is illustrated a fixture shown generally at 101 which supports the mold assembly 62 in proper position with respect to the face 13 of the bus bar assembly 12. The fixture 101 comprises a frame shown generally at 102. The frame includes a horizontally extending main U-shape frame 103 which includes legs 104 and 105 projecting toward the bus assembly 12. Projecting inwardly from the ends of such legs are relatively large pins 106 and 107 which nest within the crotch of the respective upwardly opening hooks 32 and 34. The frame also includes vertically extending outer members 109 and 110, each of which at each vertical end supports housings 112 and 113 for the four adjustable foot assemblies shown generally at 115, 116, 117 and 118. The foot assemblies include bus contacts 121, and the position of the feet may be adjusted simply by rotating the nobs 122 on each outer end. The rotation of the nobs 122 simply moves the foot assembly contacts 121 by means of a threaded connection between the foot shaft shown and the housing. The feet, as hereinafter described, ensure that the face of the mold is properly positioned to compress evenly a refractory gasket 123 seen in FIG. 9 between the face 90 of the mold and the face 13 of the bus bar.

It is also noted that the angles 82 and 83 seen in FIG. 5 are designed to engage the tops of the hooks 32 and 34 and principally support the weight of the mold assembly on the face of the bus bar.

The mold assembly is clamped against the bus bar face by the toggle mechanism shown generally at 125. The toggle mechanism is mounted on the main frame 103 and includes an operating handle 126 which is pivoted in a vertical plane and which operates adjustable plunger pad 127 bearing against the back of the mold assembly 62 when the toggle mechanism is closed and locked. The toggle operated clamp bearing against the back of the mold assembly reacts against the frame which is held in position by the pins 106 and 107 nested in the hooks 32 and 34.

Referring now to FIGS. 9 and 10, it will be seen that the crucible chamber 86 is filled with exothermic welding material shown generally at 130. It is supported on a fusible metal disk 131 above the tap hole 88. For the aluminum/copper connection illustrated, an aluminum exothermic welding composition is employed. The welding composition may be either an A22™ or an A99™ welding composition available from Erico, Inc., of Solon, Ohio, U.S.A.

The A22™ welding material is a combination of aluminum, tin and copper. While the A99™ is mostly pure aluminum, no tin and only some copper. Either weld material produces a weld metal which is mostly aluminum.

The contact 50 is positioned in the contact cavity 94 when the mold parts are opened. The flats at the side of the contact mate with the flats in the mold cavity, and as the mold parts are closed by the toggle mechanism 68, the contact is actually gripped by the mold parts. The flats then enable the proper alignment of the grooves 53–59 in the mold, and the closing of the mold parts grips and maintains the contact at the back or bottom of the contact cavity. As illustrated in FIG. 9, with the contact properly in position, there is nonetheless a gap indicated at 135 in FIG. 9 between the grooved face of the contact and the face 13 of the bus bar. With the mold closed and the crucible filled with the proper amount of exothermic weld material, the gasket material 123 is evenly compressed by the adjustable feet of the fixture. If there are substantial irregularities in the face of the bus, they may be closed with a suitable refractory sealant. With the assembly in the proper position, the exothermic material 130 is ignited, either by flint gun and a starting material, or electrically. When the exothermic material ignites the reaction maintains itself, and no additional electrical or other energy is required. As the reaction takes place, the exothermic material is converted to a molten metal and slag, and when the reaction reaches the bottom of the crucible, the disk 131 is fused, permitting the molten metal to drop through the hole 88 into the chamber 91 and to drop through the contact chamber 94 and into the overflow chamber 96. The overflow allows for hot, clean, molten weld material to wash past the aluminum bus face. This washing action cleans any oxide coating from the substrate and also preheats the substrate. As the overflow fills, the molten metal then fills the balance of the contact chamber as indicated at 135 and also the interior of the grooves in the face of the contact exposed to the weld metal. Excess weld metal and slag accumulate in the riser or wedge chamber 91.

As indicated at 140 in FIG. 1, the weld metal will actually erode part of the face of the aluminum bus. When the weld metal solidifies, it has formed a molecular weld or bond with the aluminum bus, but only a mechanical bond with the copper contact or puck. In order to enhance the electrical conductivity, the grooves or interior face of the contact may be tinned before being clamped in the mold. The application of a tin coating to the interior face of the contact provides a braze-like connection between the contact and the weld metal enhancing the electrical conductivity of the connection.

A common problem in making connections between aluminum and copper is the formation of brittle copper-aluminide complexes. These are normally present in welded, and to a lesser extent in brazed or soldered, connections. However, because the connection relies mostly on a mechanical connection with some brazing of the tin at the copper interface, the connection is less susceptible to this type of embrittlement.

Because everything on the pot line is at the same electrical potential, simply touching the bus does not complete an electrical circuit. In this manner, the connections can be made with the power on. However, because of magnetic fields and the required arc to be drawn in Mig welding, it is not practical to attempt to Mig weld a contact when the power is on.

In comparing FIGS. 9 and 10, after the mold assembly has been removed, and any overflows and risers are removed, the contact 50 is then secured to the face of the aluminum bus by the weld metal connection shown generally at 20, which forms a molecular weld with the face of the bus and a mechanical brazed connection with the inner face of the copper contact.

While the two dissimilar metals of the illustrated preferred embodiment are aluminum and copper, it will be readily appreciated that a wide variety of other types of dissimilar elements may be similarly connected, such as copper and steel. The weld material would be selected to make a fusion molecular weld bond with the element having the lower fusion temperature and a mechanical bond or connection with the element having the higher fusion temperature.

In any event, it can be seen that a dissimilar element connection is provided which comprises first and second dissimilar elements, with a hardened cast material joining said elements between the first and second elements, with the cast material being bonded to the first element and mechanically interlocked with the second.

To the accomplishment of the foregoing and related ends, the invention then comprises the features particularly pointed out in the claims, these being indicative, however, of but a few of the various ways in which the principles of the invention may be employed.

What is claimed is:

1. A method of forming a connection between first and second metals having a higher and lower fusion temperature, respectively, comprising the steps of positioning the metals to form a weld cavity therebetween, providing the surface of the second metal with an interlocking surface facing the weld cavity, and then casting molten metal into the weld cavity to form a fusion bond with the first metal, and a mechanical interlocking with the second metal.

2. A method as set forth in claim 1 including the step of placing the second metal in a mold, and then casting the molten metal into the mold.

3. A method as set forth in claim 2 including the step of placing the second metal in the bottom of a mold chamber, the balance of the chamber forming the weld cavity.

4. A method as set forth in claim 3 wherein said second and first metals are copper and aluminum, respectively.

5. A method as set forth in claim 1 including the step of providing a surface area enlargement on the surface of the second metal facing the cavity.

6. A method as set forth in claim 5 wherein the enlargement is in a ratio of from about 1.5 to about 2.5 or more.

7. A method as set forth in claim 6 wherein the enlargement is formed by circular channels intersecting the face of the second metal facing the cavity.

8. A method as set forth in claim 7 wherein said channels extend in the direction of flow.

9. A method as set forth in claim 7 wherein said channels are tinned to form a substantially brazed electrical connection when the weld metal solidifies in such channels.

10. A method of securing a copper contact to the face of an aluminum bus comprising the steps of sealing a mold against the aluminum bus face and providing the mold with a chamber having a bottom and open to the bus face, inserting a copper contact in the bottom of the chamber, the contact having a depth less than that of the chamber with the balance of the chamber forming a cavity exposed both to the aluminum bus face and the copper contact, and introducing molten metal into the cavity to weld to the bus and mechanically interlock with the contact.

11. A method as set forth in claim 10 including the step of tinning the copper contact so that said mechanical interlock includes a brazed connection.

12. A method as set forth in claim 10 comprising the step of supporting the mold from the aluminum bus face with a fixture, and sealing the mold against the bus face.

13. A method as set forth in claim 12 including the step of adjusting the fixture properly to position the chamber with respect to the bus face.

14. A method as set forth in claim 13 including the step of casting the metal to flow past the chamber into an overflow to ensure that the chamber is filled with clean hot metal.

* * * * *